US006033301A

United States Patent [19]

Suwa

[11] Patent Number: 6,033,301

[45] Date of Patent: Mar. 7, 2000

[54] FAN FILTER UNIT AND A CLEAN ROOM FOR USING THE SAME

[75] Inventor: Nobuyuki Suwa, Kanagawa, Japan

[73] Assignee: Fuji Electric Co., Ltd., Kawasaki, Japan

[21] Appl. No.: 08/957,944

[22] Filed: Oct. 27, 1997

[30] Foreign Application Priority Data

Feb. 7, 1997 [JP] Japan ..... PA9-024706
May 21, 1997 [JP] Japan ..... PA9-131285

[51] Int. Cl.[7] ..... F24F 3/16

[52] U.S. Cl. ..... 454/187; 55/385.2; 55/473; 96/132; 96/138; 96/142

[58] Field of Search ..... 454/187; 55/385.2, 55/471, 473, 484; 96/138, 142, 151

[56] References Cited

U.S. PATENT DOCUMENTS 5,053,065 10/1991 Garay et al. ..... 55/385.2 X
5,496,389 3/1996 Wilcox ..... 55/473
5,772,738 6/1998 Muraoka ..... 96/138 X

FOREIGN PATENT DOCUMENTS 61-138040 6/1986 Japan ..... 454/187
3-271645 12/1991 Japan ..... 454/187
4-214137 8/1992 Japan .
4-214140 8/1992 Japan ..... 454/187
4-347435 12/1992 Japan ..... 454/187
5-141731 6/1993 Japan ..... 454/187

*Primary Examiner*—Harold Joyce
*Attorney, Agent, or Firm*—Baker & Botts, L.L.P.

[57] ABSTRACT

A fan filter unit is provided for use in filtering air circulating in a clean room. The fan filter unit includes a unit casing; a ventilation fan housed in the unit casing; a dust removal filter in the bottom of the unit casing; and one or more gas absorption filters for removing gases from the circulating air. The one or more gas absorption filters are located in the unit casing such that the ventilation fan can be inspected without removing the one or more gas absorption filters and an inspector can walk on an upper face of the unit casing. In one preferred embodiment, the one or more gas absorption filters are located above the dust removal filter and below the ventilation fan. In a second preferred embodiment, a fan filter unit is provided that includes a plurality of fan filter subunits, each fan filter subunit comprising a unit casing, a ventilation fan housed in the unit casing, and a dust removal filter in the bottom of the unit casing. The fan filter unit also includes a chamber enclosing the intake sides of the plurality of fan filter subunits, the chamber containing one or more air intake openings in the sides of the chamber. The fan filter unit also includes one or more gas absorption filters for removing gases from the air disposed in the one or more air intake openings of the chamber.

13 Claims, 5 Drawing Sheets

FAN FILTER UNIT AND A CLEAN ROOM FOR USING THE SAME

BACKGROUND OF THE INVENTION

The present invention relates to a fan filter unit and to a vertical laminar-flow type clean room including one or more of such fan filter units (such as the clean rooms used in manufacturing semiconductor devices).

In clean rooms, fan filter units serve two main purposes. First, the fan filter units serve to filter dust and other small particles from the clean room air. Second, because a clean room may contain gases that may be hazardous to the health of workers or damaging to the processes being carried out in the clean room, the fan filter units serve to filter unwanted gases from the clean room air. For example, in a clean room in which a semiconductor manufacturing line is constructed, various reagents such as hydrofluoric acid and hydrochloric acid are used in the chemical stations arranged along the semiconductor manufacturing line. Although treatment systems are installed to neutralize any reagent gases escaping into the air, the treatment systems are not completely effective, and trace amounts of the reagent gases still escape from the chemical station into the work areas in the clean room without being treated. In addition to reagent gases, some organic gases are given off by the construction materials in the clean room. Moreover, nitrogen oxides such as $NO_x$ and sulfur oxides such as $SO_x$ are contained in the fresh air circulated in the clean room from the outside. Further, various toxic gases are generated by the corrosion of glass fiber by hydrofluoric acid in the high-performance filters used in the clean room. Ammonia gas also evaporates from the bodies of the workers. These hazardous gases cause chemical contamination of the air in the clean room. This chemical contamination circulating in the clean room may be hazardous to the health of the workers and may deteriorate the film quality of semiconductor devices in certain steps of semiconductor processes.

FIGS. 4(*a*) and 4(*b*) illustrate two types of conventional vertical laminar-type flow clean rooms and their circulation systems. In FIG. 4(*a*), there is shown a clean room 1, a free-access floor 1*a* of the clean room 1, semiconductor manufacturing facilities 2 mounted on the floor 1*a* of the clean room 1, a dust removal filter 3 (such as a high performance HEPA filter or a ULPA filter) distributed over the ceiling of the clean room 1, an air conditioning unit 4 located outside of the clean room 1, a ventilation unit 5 for air circulation, and gas absorption filters 6. The gas absorption filters 6 are located in ventilation ducts that lead from underneath the floor 1*a* of the clean room 1 to the air conditioning unit 4 and ventilation unit 5. In FIG. 4(*a*), air is circulated downward from the dust removal filter 3 through the clean room to the free access floor 1*a*, through the gas absorption filters 6, air conditioner unit 4 and ventilator unit 5, and back to the dust removal filter 3. The air conditioner unit 4 has an intake for fresh air as well as for the circulating air of the clean room.

The second type of circulation system shown in FIG. 4(*b*) is similar to that shown in FIG. 4(*a*), except that instead of a separate dust removal filter 3 and ventilation unit 5, the system in FIG. 4(*b*) has a plurality of fan filter units 7 arranged along the ceiling of the clean room. The fan filter units 7 incorporate both functions of the dust removal filter 3 and the ventilation unit 5.

FIG. 5(*a*) is a cross-sectional view of a conventional fan filter unit used in the circulation system of FIG. 4(*b*). As illustrated in FIG. 5(*a*), each fan filter unit 7 includes a ventilation fan 7*c*, a dust removal filter 7*b*, a unit casing 7*c* (housing the ventilation fan 7*c* and dust removal filter 7*b*), and a gas absorption filter 6 housed in an air intake duct 7*d* on the side wall of the unit casing 7*c*.

FIG. 5(*b*) is a cross-sectional view of another conventional fan filter unit. In the fan filter unit 7 of FIG. 5(*b*), a gas absorption filter 6 is mounted on the upper surface of a unit casing 7*c* such that the gas absorption filter 6 covers an air intake 7*d* of a ventilation fan 7*c*.

The foregoing conventional fan filter units pose several problems in terms of the removal of hazardous gases from the clean room work area, the layout of the fan filter units in the clean room, and the ease of maintenance of the fan filter units.

First, when the centralized-type clean room as shown in FIG. 4(*a*) is divided into a plurality of clean work areas A, B and C, as illustrated by dashed lines in the figure, and different steps of the semiconductor process are conducted in the different clean room work areas, a variety of hazardous gases with varying properties are produced depending on the reagents used in the steps of the semiconductor process performed in the different work areas. Since the gas absorption filter 6 is inserted in the ventilation paths common to the clean room work areas A, B and C, a type of gas absorption filter selected for removing one type of gas (for example, either an alkaline gas, an oxide gas, or an organic gas) may not be suitable for removing other kinds of hazardous gases produced from the other work areas.

Second, in the distributed type of clean room as shown in FIG. 4(*b*), the gas absorption filter 6 is mounted in the air intake 7*d* of the unit casing 7*c* of each fan filter unit 7. Due to this arrangement, it is necessary to space the adjacent fan filter units 7 apart from each other and to secure spaces between the adjacent fan filter units 7 for clearance of the air intake ducts and for the maintenance of the gas absorption filters. Therefore, the arrangement of the fan filter units 7 is limited, and it is difficult to add more fan filter units.

Third, in the configuration of the fan filter unit shown in FIG. 5(*b*), although the space limitation described above is not present, time and manpower are required to remove the gas absorption filter 6 covering the upper face of the unit casing 7*c* for the inspection of the ventilation fan 7*c* housed in the fan filter unit 7. In addition, in the configuration of the fan filter unit shown in FIG. 5(*b*), because of the placement of the gas absorption filter 6 on the upper face of the fan filter unit 7, it is hazardous for workers to walk on the unit casing 7*c* during maintenance operations of the fan filter unit 7. Therefore, the costs of the clean room facilities soar, since it is necessary to provide a separate path above the fan filter units for their maintenance.

BRIEF SUMMARY OF THE INVENTION

In view of the foregoing, it is an object of the invention to provide a fan filter unit that improves the ease of maintenance of the unit once it is installed in a clean room.

It is another object of the invention to provide a fan filter unit which provides flexibility of installation thereby accommodating layout changes and additions of work areas in the clean room.

It is still another object of the invention to provide a fan filter unit which facilitates the selective removal of hazardous gases from a specific clean room work area.

It is also an object of the invention to provide a clean room that utilizes one or more of the fan filter units of the present invention.

According to the present invention, there is provided a fan filter unit for use in filtering air circulating in a clean room, the fan filter unit including a unit casing, a ventilation fan housed in the unit casing, a dust removal filter in the bottom of the unit casing, and one or more gas absorption filters for removing gases from the circulating air, the one or more gas absorption filters located such that the ventilation fan can be inspected without removing the gas filter and inspectors can walk on an upper face of the unit casing.

According to a preferred embodiment of the present invention, there is provided a fan filter unit for use in filtering air circulating in a clean room, the fan filter unit including a unit casing, a ventilation fan housed in the unit casing, a dust removal filter in the bottom of the unit casing, and one or more gas absorption filters for removing gases from the circulating air, the one or more gas absorption filters being above the dust removal filter and below the ventilation fan.

Advantageously, each gas absorption filter is selected from the group consisting of an alkaline gas absorption filter, an acidic gas absorption filter and an organic gas absorption filter depending on the properties of the hazardous gases to be removed from the specific clean room work area below the fan filter unit.

In addition, it is preferred that the fan filter unit of the present invention have an air intake for the ventilation fan located in the upper face of the unit casing. It is also preferred that the fan filter unit have inspection openings located in the upper face of the unit casing for removing the one or more gas absorption filters from the unit casing and for inserting the one or more gas absorption filters into said unit casing. It is also preferred that the fan filter unit include covers for the inspection openings.

Preferably, the one or more gas absorption filters are placed side by side on the dust removal filter, the inspection openings are separated by the air intake for the ventilation fan, and the number and location of the inspection openings correspond to the number and location of the one or more gas absorption filters. In this configuration, the gas absorption filters may be inserted or removed through their respective inspection openings for the purpose of inspection or replacement without removing the ventilation fan from the unit casing.

In addition to facilitating inspection of the ventilation fan and making it easier for inspectors to walk freely on the unit casing of the fan filter unit, the fan filter unit of the preferred embodiment of the present invention also reduces fan noise because the gas absorption filters placed below the ventilation fan also work as sound absorbing material and reduce the noise from the fan propagating into the clean room via the bottom face of the unit casing. The preferred embodiment of the fan filter unit of the present invention also facilitates additional installation and relocation of fan filter units in association with up-grades of the air cleanness level of a clean room and changes of arrangement of manufacturing facilities located in a clean room. The fan filter unit of the invention also provides flexibility in the selection of gas absorption filters for each clean room work area.

According to another preferred embodiment of the present invention, there is also provided a fan filter unit for use in filtering air circulating in a clean room, the fan filter unit including a plurality of fan filter subunits, each fan filter subunit comprising a unit casing, a ventilation fan housed in the unit casing, and a dust removal filter in the bottom of the unit casing. The fan filter unit also includes a chamber enclosing the intake sides of the plurality of fan filter subunits, the chamber containing one or more air intake openings in the sides of the chamber. The fan filter unit also includes one or more gas absorption filters for removing gases from the circulating air, the one or more gas absorption filters disposed in the one or more air intake openings of the chamber.

The present invention is also directed to vertical laminar-flow type clean rooms that include one or more fan filter units of the present invention.

BRIEF DESCRIPTION OF THE DRAWINGS

FIG. 2(*b*) is a cross-sectional view of a fan filter unit according to the preferred embodiments of FIGS. 1 and 2(*a*), taken along line 2(*b*)—2(*b*) of FIG. 2(*a*);

FIG. 4(*b*) is a cross-sectional view of another conventional clean room and a circulation system for the clean room;

FIG. 5(*b*) is a cross-sectional view of another conventional fan filter unit.

DETAILED DESCRIPTION OF THE INVENTION

Figure 1:
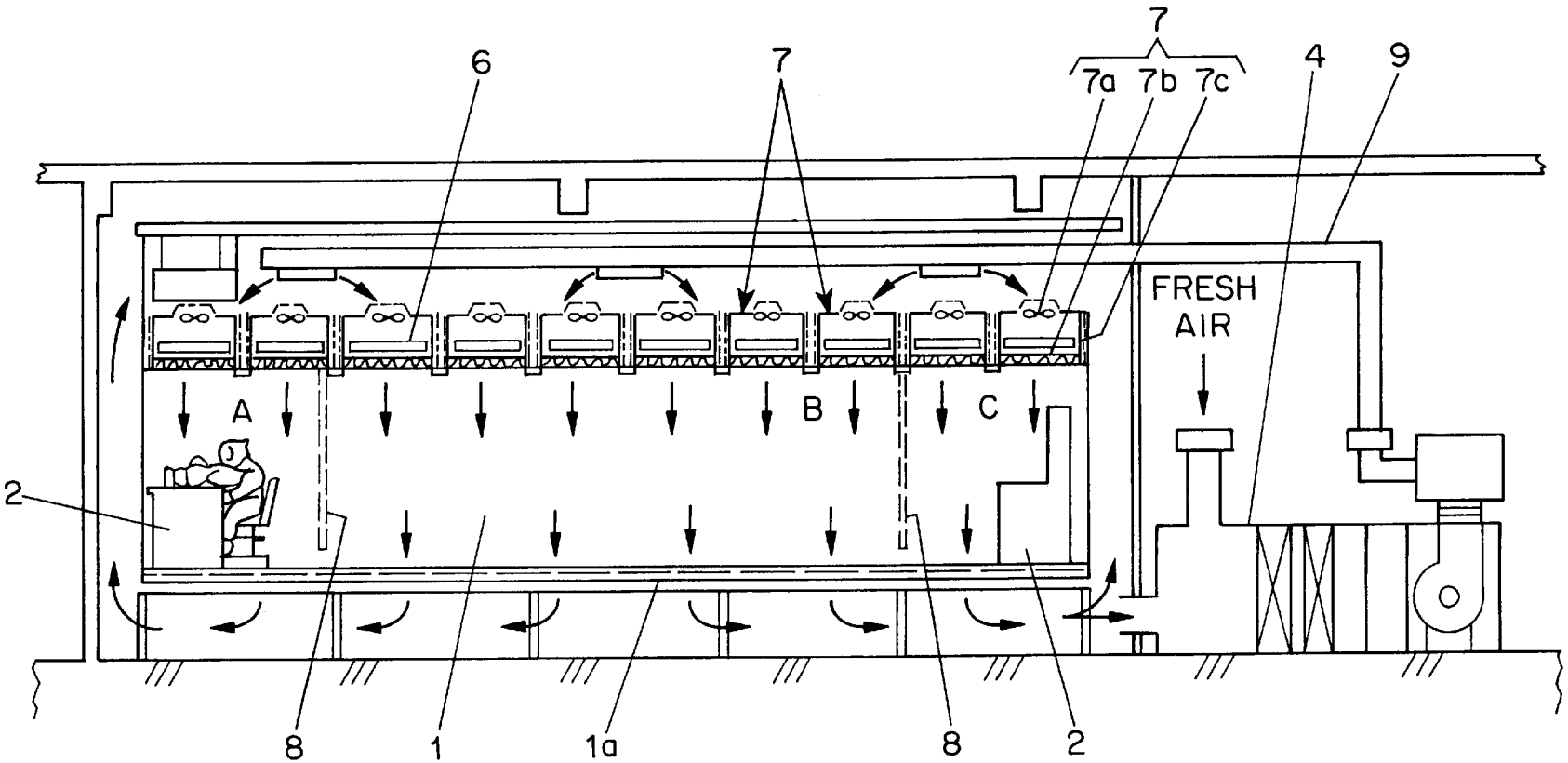
FIG. 1 is a cross-sectional view of a clean room and a circulation system for the clean room, which utilize fan filter units according to a preferred embodiment of the present invention.

Now the present invention will be explained hereinafter with reference to the accompanying figures, which illustrate the preferred embodiments of the invention. Throughout these figures, like parts are designated by like reference numerals.

First Preferred Embodiment

Referring to FIG. 1, a first preferred embodiment of the invention is shown. A clean room 1 is divided into clean room work areas A, B and C by a plurality of separation walls 8. A rail-shaped support frame is hung on hangers which are fixed to crossbeams of the building, and a plurality of fan filter units 7 are arranged in a grid pattern on the support frame. An air supply duct 9 from an air conditioning unit 4 extends above the fan filter units 7.

Figure 2A:
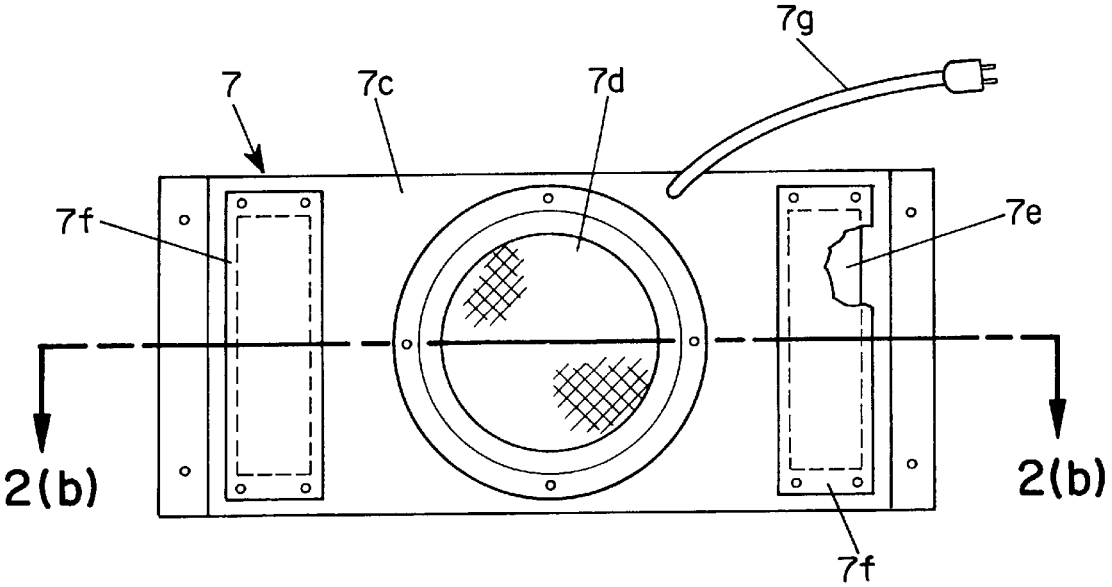
FIG. 2(*a*) is a top plan view of a fan filter unit according to the preferred embodiment of FIG. 1.
Figure 2B:
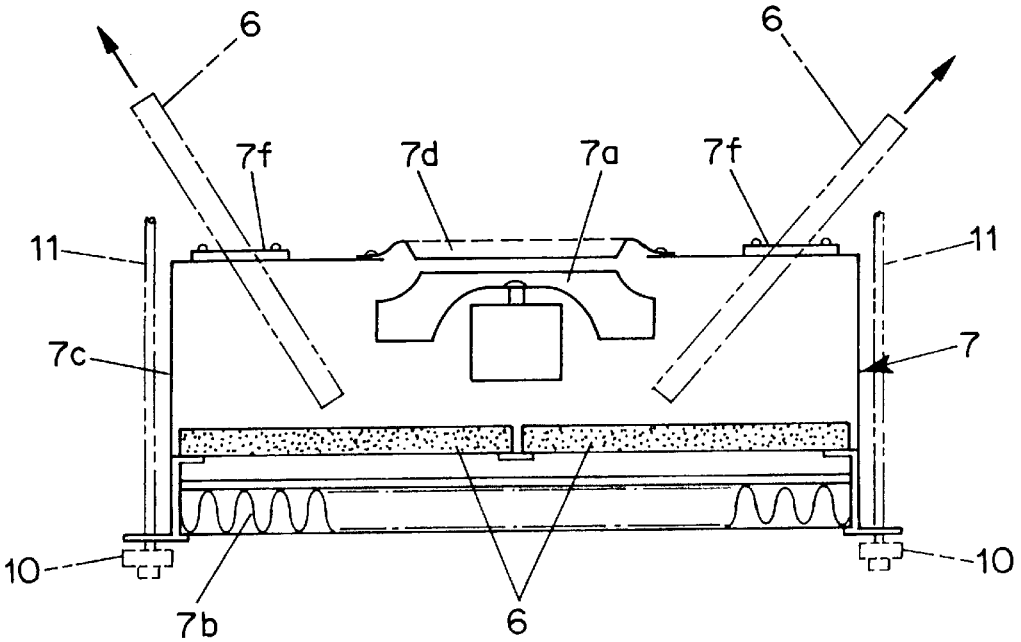

Referring now to FIGS. 2(*a*) and 2(*b*), each fan filter unit 7 includes a box-shaped unit casing 7*c* made of stainless steel (steel highly resistant to corrosion), a ventilation fan 7*c* arranged in the upper part of the unit casing 7*c*, a dust removal filter 7*b* (such as a HEPA filter or an ULPA filter) arranged along the bottom of the unit casing 7*c*, and mat-shaped gas absorption filters 6 arranged in the space between the ventilation fan 7*c* and the dust removal filter 7*b*. The gas absorption filters 6 are placed side by side in the unit casing 7*c*. Inspection openings 7*e* for inspecting the gas absorption filters 6 are located on the upper face of the unit casing 7*c*. The inspection openings 7*e* are separated by an air intake 7*d* which permits air to flow into the ventilation fan 7*c*. A cover 7*f* covers each inspection opening 7*e*. A wiring cord 7*g* of the ventilation fan 7*c* leads out from the unit casing 7*c*. In FIG. 2(*a*), there is also shown a support frame 10 for supporting the fan filter unit 7 and a hanger 11 for hanging the support frame 10.

Each gas absorption filter 6 includes a carrier mat, which contains active carbon. Preferably, the carrier mat is made of a material having many open pores, such as foamed polyurethane. In addition, the material preferably is around 20 mm in thickness and of low pressure loss. The active carbon is preferably about 0.5 mm in diameter.

Preferably, three types of gas absorption filter are used corresponding to the properties of the gases to be absorbed: an alkaline gas absorption filter, an acidic gas absorption filter, and an organic gas absorption filter. The alkaline gas absorption filter includes a small amount of phosphoric acid as an auxiliary agent for neutralizing the alkaline gases to be absorbed. The acidic gas absorption filter includes potassium carbonate as an auxiliary agent for neutralizing the acidic gases to be absorbed. The organic gas absorption filter, however, includes no auxiliary agent.

These types of filters are selectively used for each gas absorption filter 6 of the fan filter unit 7 depending on the hazardous gases present in the clean room work areas A, B or C, respectively. For example, in a clean room work area in which $NO_x$ and $SO_x$ gases may be harmful to the products of the semiconductor process in that work area, an acidic gas absorption filter is used in combination with an organic gas absorption filter. In another work area in which ammonia may damage the products of the semiconductor process, an alkaline gas absorption filter is used in combination with an organic gas absorption filter.

In the clean room configuration described above, air flows into the clean room from the air supply duct 9 located above the work areas. From the air supply duct 9, air flows down into the clean room 1 through the fan filter units 7, permeates the free access floor 1*a*, and returns to the air conditioning unit 4. The circulation of air in the clean room is indicated by the arrows in FIG. 1.

In this circulation process, small particles (such as small dust particles) floating in the circulating air are captured by the dust removal filter 7*b* and hazardous gases such as reagent gases produced by the semiconductor processes in the clean room 1 or contaminants from the fresh air drawn in by the air conditioner 4 are absorbed by the gas absorption filters 6. Thus, the work areas in the clean room 1 are maintained in a highly purified state.

It is necessary to inspect and replace the fan filter unit 7 periodically, since the function of the gas absorption filters 6 decreases as they absorb hazardous gases. For the purpose of maintenance work, the covers 7*f* are detached from their respective inspection openings 7*e* and the gas absorption filters 6 are replaced through the inspection openings 7*e* as indicated by the dotted lines in FIG. 2(*b*).

The ventilation fan 7*c* housed in the unit casing 7*c* is inspected easily through the air intake 7*d* when its cover is detached, even while the gas absorption filters 6 remain in the unit casing 7*c*. Moreover, inspectors can walk freely on the stainless steel casings 7*c* of the fan filter units 7 sustained with support frames 10.

Second Preferred Embodiment

Figure 3:
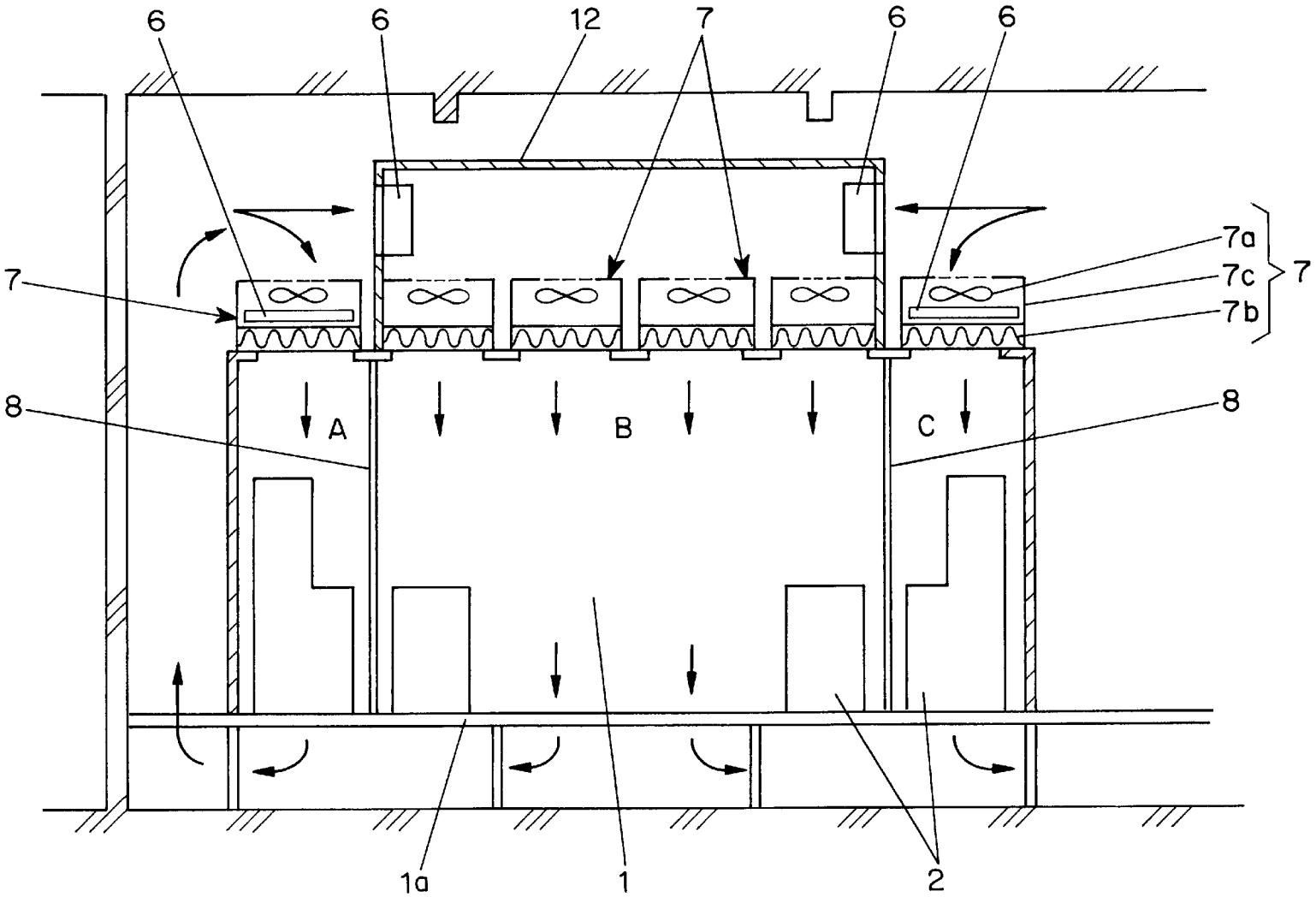
FIG. 3 is a cross-sectional view of a clean room and circulation system for a clean room, which utilize a group of enclosed fan filter units according to another preferred embodiment of the present invention.
Figure 4A:
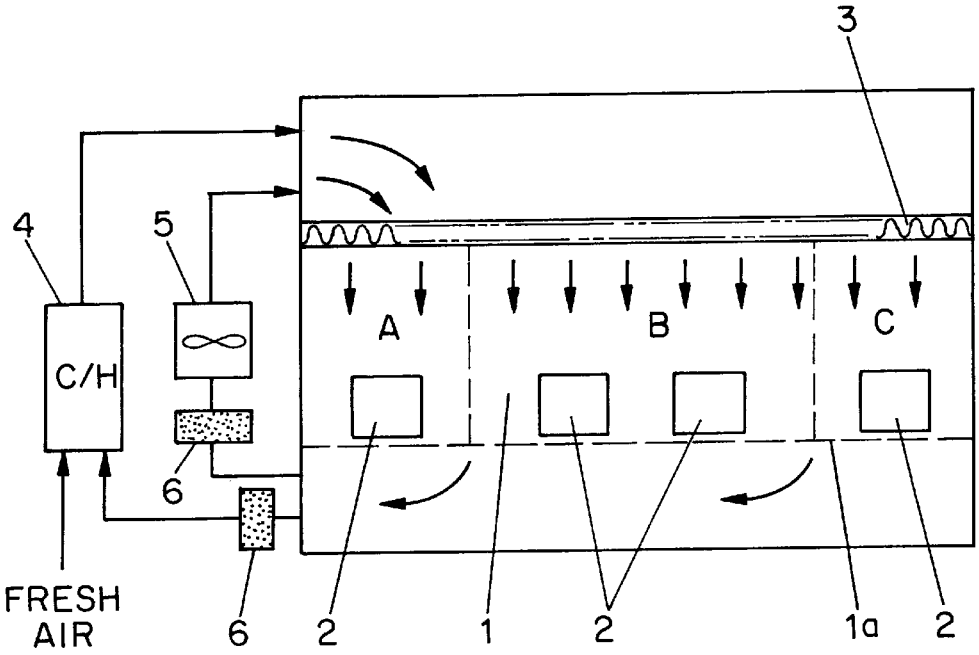
FIG. 4(a) PRIOR ART
FIG. 4(*a*) is a cross-sectional view of a conventional clean room and a circulation system for the clean room.
Figure 4B:
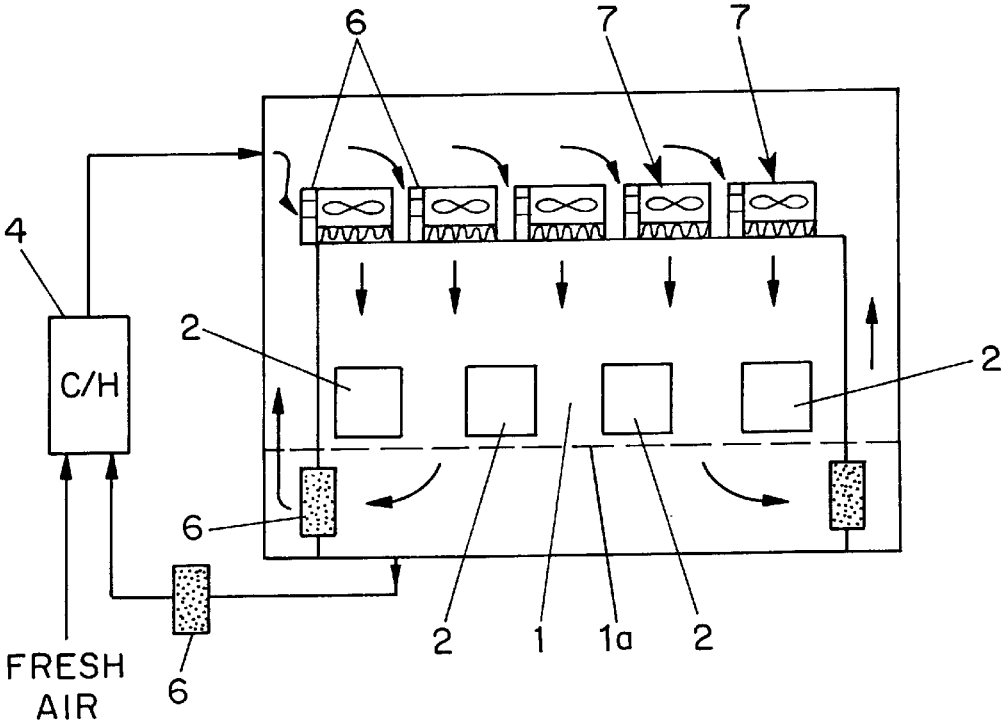
FIG. 4(b) PRIOR ART
Figure 5A:
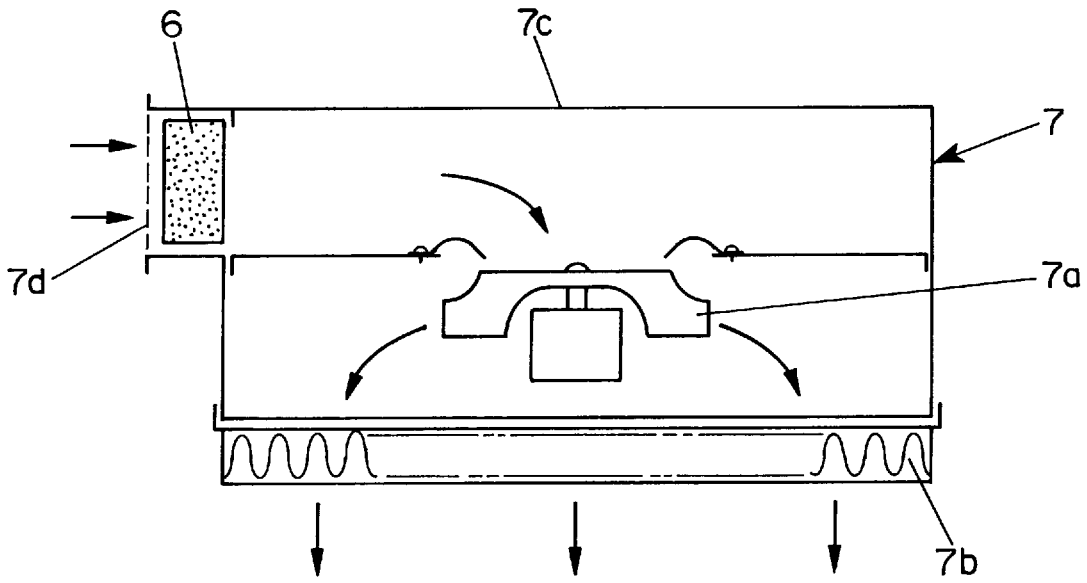
FIG. 5(a) PRIOR ART
FIG. 5(*a*) is a cross-sectional view of a conventional fan filter unit used in the clean room and circulation system of FIG. 4(*b*)
Figure 5B:
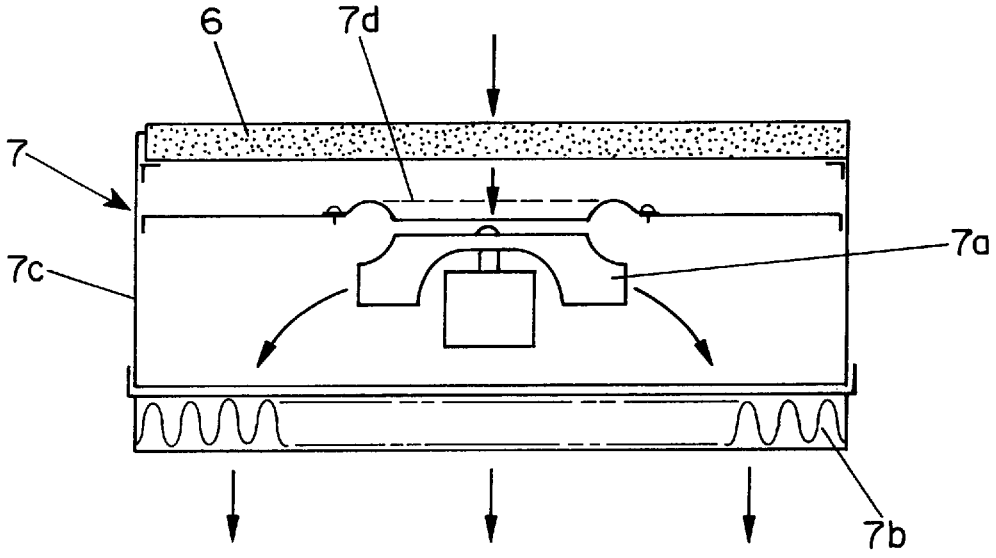
FIG. 5(b) PRIOR ART

Referring to FIG. 3, a second preferred embodiment is shown. A clean room 1 is divided into clean room work areas A, B and C, which are isolated from one another by separation walls 8. A plurality of fan filter units 7 arranged above area B are grouped together into a unit, and a chamber 12 encloses these filters on their intake side. Gas absorption filters 6 are mounted in a detachable manner on air intakes located in the side walls of the chamber 12. The fan filter units 7 arranged inside the chamber 12 do not contain any gas absorption filters. As illustrated in FIG. 3, the fan filter units 7 disposed above work areas A and C include gas absorption filters 6 as in the first preferred embodiment.

The gas absorption filters 6 installed in the chamber 12 are selected from the group consisting of an acidic gas absorption filter, an alkaline gas absorption filter, and an organic gas absorption filter, the selection depending on the properties of the gases that are harmful to the semiconductor process or processes conducted in the clean room work area B. Thus, in the configuration described above, air is taken into the chamber 12 and is filtered through the fan filter units 7 arranged inside the chamber 12. The clean air flows downwardly into the clean room work area B. Specific gases contaminating the air taken into the chamber 12 (gases harmful to the processes in area B) are removed by the gas absorption filters 6.

Advantages of the Invention

The fan filter unit of the present invention has the following advantages. The ventilation fan housed in the fan filter unit can be inspected without detaching the gas absorption filters from the unit casing. In addition, inspection workers can walk on the unit casing of the fan filter unit with no problem.

Furthermore, in the first preferred embodiment of the present invention, the gas absorption filters placed below the ventilation fan also work as sound absorbing material and reduce the noise from the fan propagating into the clean room via the open face of the unit casing. The fan filter unit of the present invention facilitates additional installation and relocation of fan filter units in association with up-grades of the air cleanness level of a clean room and layout changes of manufacturing facilities located in a clean room. The fan filter unit of the present invention also provides flexibility in the selection of gas absorption filters for each clean room work area.

Moreover, in the first preferred embodiment of the present invention, by laying the gas absorption filters side by side and by placing the air intake of the ventilation fan and inspection openings in the upper face of the unit casing, the gas absorption filters may be inserted or removed through their respective inspection openings for inspection or replacement without removing the ventilation fan.

In addition, in the second preferred embodiment, by providing a chamber for the enclosure of a plurality of fan filter units above a specific clean room work area and by installing gas absorption filters in the air intakes located in the side walls of the chamber (the selection of the gas absorption filters corresponding to the gases harmful to the processes conducted in the clean room work area under the chamber), the number of gas absorption filters necessary for a specific clean room work area may be reduced in comparison with an arrangement of individual fan filter units above the same clean room work area and, therefore, the cost performance of the clean room is improved.

I claim:

1. A fan filter unit for use in filtering air circulating in a clean room, the fan filter unit comprising:

a unit casing having a top and a bottom;

a ventilation fan housed in said unit casing;

a dust removal filter in said bottom of said unit casing;

one or more gas absorption filters located in said casing between said fan and said dust removal filter for removing gases from said circulating air; and at least one opening in an upper face of said unit casing for permitting inspection of at least one of said fan and said one or more gas absorption filters without disassembling said unit casing.

2. A fan filter unit for use in filtering air circulating in a clean room, the fan filter unit comprising:

a unit casing having a top and a bottom;

a ventilation fan housed in said unit casing;

a dust removal filter in said bottom of said unit casing;

one or more gas absorption filters for removing gases from said circulating air, said one or more gas absorption filters being above said dust removal filter and below said ventilation fan; and at least one opening in an upper face of said unit casing for replacing said one or more gas absorption filters without removing said dust removal filter.

3. The fan filter unit according to claim 2, wherein each of said one or more gas absorption filters is selected from the group consisting of an alkaline gas absorption filter, an acidic gas absorption filter, and an organic gas absorption filter.

4. A fan filter unit for use in filtering air circulating in a clean room, the fan filter unit comprising:

a unit casing;

a ventilation fan housed in said unit casing;

a dust removal filter in the bottom of said unit casing:

one or more gas absorption filters for removing gases from said circulating air, said one or more gas absorption filters being above said dust removal filter and below said ventilation fan;

an air intake for said ventilation fan located in an upper face of said unit casing;

inspection openings located in said upper face of said unit casing for removing said one or more gas absorption filters from said unit casing and for inserting said one or more gas absorption filters into said unit casing; and covers for said inspection openings.

5. The fan filter unit according to claim 4, wherein said one or more gas absorption filters are placed side by side on said dust removal filter, said inspection openings are separated by said air intake for said ventilation fan, and the number, size, and location of said inspection openings correspond to the number, size, and location of said one or more gas absorption filters.

6. A vertical laminar-flow type clean room, comprising:

one or more work areas;

a circulation system for circulating air downwardly through the clean room;

one or more fan filter units located above the one or more work areas, each fan filter unit comprising:

a unit casing having a top and a bottom;

a ventilation fan housed in said unit casing;

a dust removal filter in said bottom of said unit casing;

one or more gas absorption filters for removing gases from said circulating air, said one or more gas absorption filters being above said dust removal filter and below said ventilation fan; and at least one opening in an upper face of said unit casing for replacing said one or more gas absorption filters without removing said dust removal filter.

7. The clean room according to claim 6, wherein each of said one or more gas absorption filters is selected from the group consisting of an alkaline gas absorption filter, an acidic gas absorption filter, and an organic gas absorption filter.

8. A vertical laminar-flow type clean room comprising:

one or more work areas;

a circulation system for circulating air downwardly through the clean room;

one or more fan filter units located above the one or more work areas, each fan filter unit comprising:

a unit casing;

a ventilation fan housed in said unit casing;

a dust removal filter in the bottom of said unit casing; and one or more gas absorption filters for removing gases from said circulating air, said one or more gas absorption filters being above said dust removal filter and below said ventilation fan;

an air intake for said ventilation fan located in an upper face of said unit casing;

inspection openings located in said upper face of said unit casing for removing said one or more gas absorption filters from said unit casing and for inserting said one or more gas absorption filters into said unit casing; and covers for said inspection openings.

9. The clean room according to claim 8, wherein said one or more gas absorption filters are placed side by side on said dust removal filter, said inspection openings are separated by said air intake for said ventilation fan, and the number, size, and location of said inspection openings correspond to the number, size, and location of said one or more gas absorption filters.

10. A fan filter unit for use in filtering air circulating in a clean room, the fan filter unit comprising:

a plurality of fan filter subunits, each fan filter subunit comprising a unit casing, a ventilation fan housed in said unit casing, and a dust removal filter in the bottom of said unit casing;

a chamber enclosing the intake sides of said plurality of fan filter subunits, said chamber containing one or more air intake openings common to said plurality of fan filter subunits; and a gas absorption filter for removing gases from said circulating air disposed in each of said one or more air intake openings of said chamber.

11. The fan filter unit of claim 10, wherein each of said one or more gas absorption filters is selected from the group consisting of an alkaline gas absorption filter, an acidic gas absorption filter, and an organic gas absorption filter.

12. A vertical laminar-flow type clean room, comprising:

one or more work areas;

a circulation system for circulating air downwardly through the clean room;

one or more fan filter units located above the one or more work areas, at least one of said fan filter units comprising:

a plurality of fan filter subunits, each fan filter subunit comprising a unit casing, a ventilation fan housed in said unit casing, and a dust removal filter in the bottom of said unit casing;

a chamber enclosing the intake sides of said plurality of fan filter subunits, said chamber containing one or more air intake openings common to said plurality of fan filter subunits; and a gas absorption filter for removing gases from said circulating air disposed in each of said one or more air intake openings of said chamber.

13. The fan filter unit of claim 12, wherein each of said one or more gas absorption filters is selected from the group consisting of an alkaline gas absorption filter, an acidic gas absorption filter, and an organic gas absorption filter.

* * * * *